United States Patent [19]

Surdi

[11] Patent Number: 4,478,554

[45] Date of Patent: Oct. 23, 1984

[54] FAN BLADE AXIAL AND RADIAL RETENTION DEVICE

[75] Inventor: Jean M. Surdi, Melun, France

[73] Assignee: S.N.E.C.M.A., Evry, France

[21] Appl. No.: 542,972

[22] Filed: Oct. 18, 1983

[30] Foreign Application Priority Data

Nov. 8, 1982 [FR] France ..... 82 18653

[51] Int. Cl.[3] ..... F01D 5/32

[52] U.S. Cl. ..... 416/221; 416/220 R

[58] Field of Search ..... 416/220 R, 221, 220 A

[56] References Cited

U.S. PATENT DOCUMENTS

| | | | |
|---|---|---|---|
| 3,653,781 | 4/1972 | Cooper | 416/221 |
| 3,832,092 | 9/1974 | Manharth | 416/220 |
| 3,936,234 | 2/1976 | Tucker et al. | 416/220 R |
| 4,033,705 | 7/1977 | Leubering | 416/220 R |
| 4,208,170 | 6/1980 | Tucker et al. | 416/221 |
| 4,265,595 | 5/1981 | Bucy, Jr. et al. | 416/221 |
| 4,405,285 | 9/1983 | Surdi | 416/220 R |

FOREIGN PATENT DOCUMENTS

| | | | |
|---|---|---|---|
| 1570396 | 6/1969 | France | 416/220 |
| 2426151 | 12/1979 | France | 416/220 |
| 1491480 | 11/1977 | United Kingdom | 416/221 |
| 2026101 | 1/1980 | United Kingdom | 416/220 |

*Primary Examiner*—Charles E. Phillips
*Assistant Examiner*—John Kwon
*Attorney, Agent, or Firm*—Oblon, Fisher, Spivak, McClelland & Maier

[57] ABSTRACT

Axial and radial fan blade retention device, the blade comprising a root of dovetail or other re-entrant form capable of being engaged by axial sliding in corresponding bores of the rim of the disc.

It comprises a member of elastomer material in the form of a trough extending axially and interposed between a wedge and the flanks and the base of a groove, the trough having an opening in which is engaged an abutment of the wedge constituting a central seating of the wedge on the base of the groove.

7 Claims, 2 Drawing Figures

FAN BLADE AXIAL AND RADIAL RETENTION DEVICE

BACKGROUND OF THE INVENTION

1. Field of the Invention

The present invention relates to a fan blade axial and radial retention device.

2. Summary of the Prior Art

Axial and radial retention devices for fan blades have been proposed, for example in French Patent specification No. 2 345 605 which describes a device constituted by a wedge which is disposed between the root of a blade and the base of a groove provided in the rim of the rotor disc so as to apply the part of the root of the blade of dovetail form radially the furthest from the axis, against lateral teeth of the groove, the wedge being secured in the axial sense by a U-shaped bar which cooperates with corresponding notches provided in the root of the blade and in the teeth of the groove. This device also comprises a key interposed between the tip of the wedge and the front of the blade root.

During auto-rotation or rotation of the rotor at low speeds, the centrifugal force which is exerted on the blades is not sufficient to hold the roots of the blade applied simultaneously against the two inclined faces of the groove. At each turn, the blades pass from a support position on one of the sides of the groove to a support position on the other side. This gives rise to clicking and, which is more serious, a hammering effect which seriously damages the contact surfaces. If such damage is hardly acceptable for parts which are readily replaceable, such as the wedges, or the blades themselves, it is not the same for the rotor disc for which such damage is absolutely non-acceptable.

French Patent specification No. 2,029,000 discloses a radial securing device for a fan blade comprising a wedge of moulded elastomer material interposed between the root of the blade and the base of a groove or recess.

This insert of elastomer serves a damping role and reduction in the friction zones between the root of the blade and the groove; however, this device does not include a metallic element under stress exerting a substantial force against the blade root.

From French Patent specification No. 2,376,958 there is known a vibration damping device formed by an element of elastomer material in which is embedded an elastically-deformable metallic part. However, in this damping device, the thin steel sheet moulded into the elastomer does not in fact exert a force in the radial direction on the blades, but acts only to hold the damping device in contact with the plates.

The present invention has for its object a device serving to exert on the root of the blade, a substantial force in the radial direction and to improve the securing of the coverings applied on the bulb of the blade roots or on the flanks of the grooves of the disc.

SUMMARY OF THE INVENTION

According to the present invention, there is provided in a retention device for use in securing a fan blade axially and radially, the blade having a platform and a root of re-entrant form and thus being capable only of axial sliding into a corresponding groove in the rim of a fan rotor disc, means defining axially-extending teeth adjacent the periphery of the rim of the disc and adjacent pairs of said teeth having opposed radial recesses, locking means of each blade being engaged in said two adjacent opposed recesses and serving to lock the blade axially, a resilient wedge interposed between the root of the blade and the bottom of the groove in order to exert on the blade root a force directed radially outwardly, and a holding key pre-stressing the wedge and interposed between the wedge and the internal downstream face of the root of the blade, the improvement comprising, a trough-shaped member interposed between the resilient wedge and the flanks and bottom of said groove, the trough-shaped member extending axially of the fan, and having an opening intermediate its ends, and means defining an abutment on the wedge which engages in the opening of the trough-shaped member and seats on the bottom of the groove.

With the aid of the device in accordance with the invention, centring of the wedge within the groove is ensured by the trough-shaped member together with satisfactory functioning of the axial abutment. Furthermore, the trough-shaped member of elastomer interposed between the flanks of the groove of the wedge and the surface of the contact zones is also reduced.

Finally, the wedge can be stamped out by deep drawing or can be machined, so that simplified manufacture and reduced costs result.

DESCRIPTION OF THE PREFERRED EMBODIMENT

Figure 1:
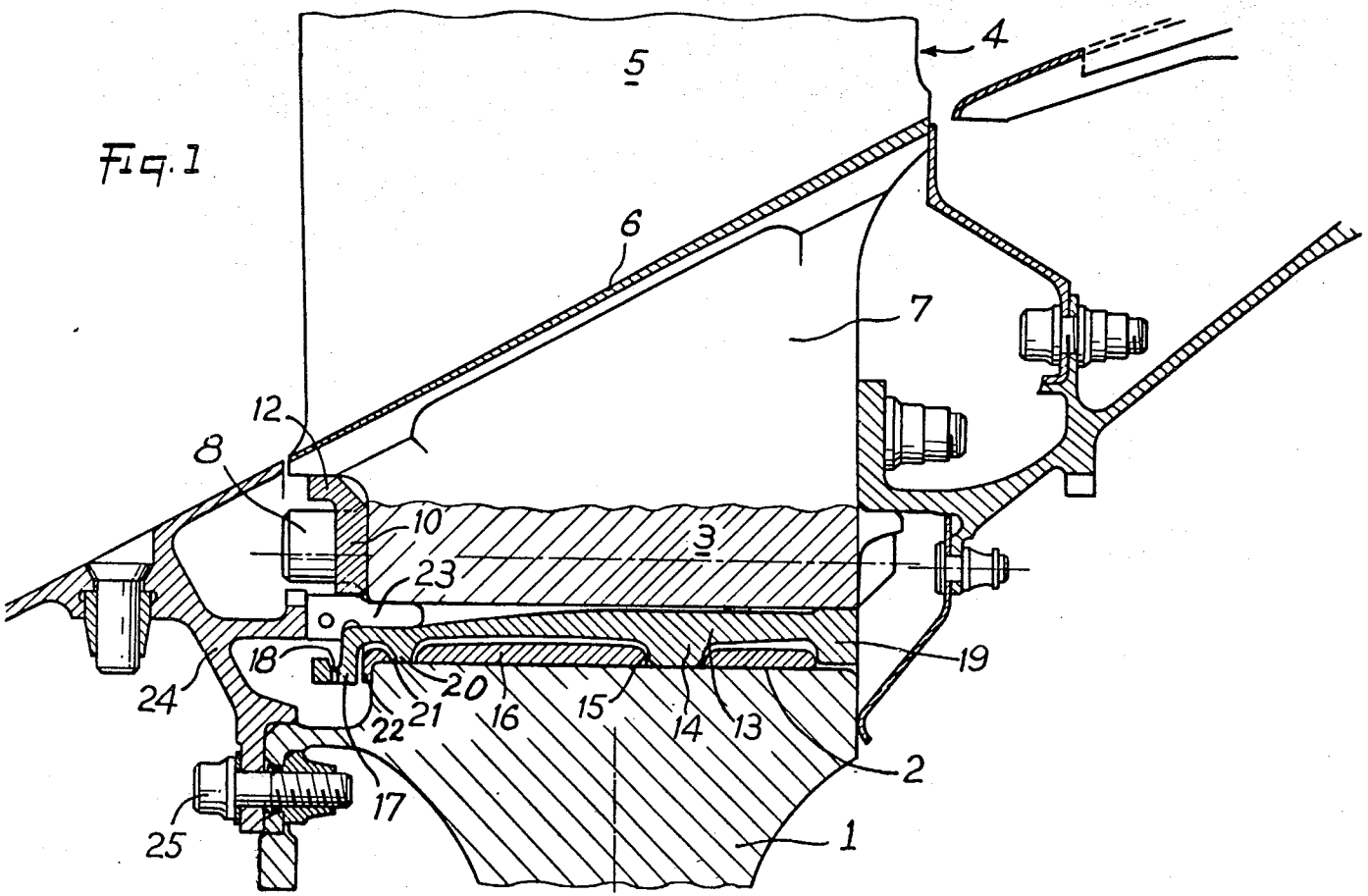
FIG. 1 is a view in elevation and in radial section of a fan blade axial and radial retaining device embodying the invention.
Figure 2:
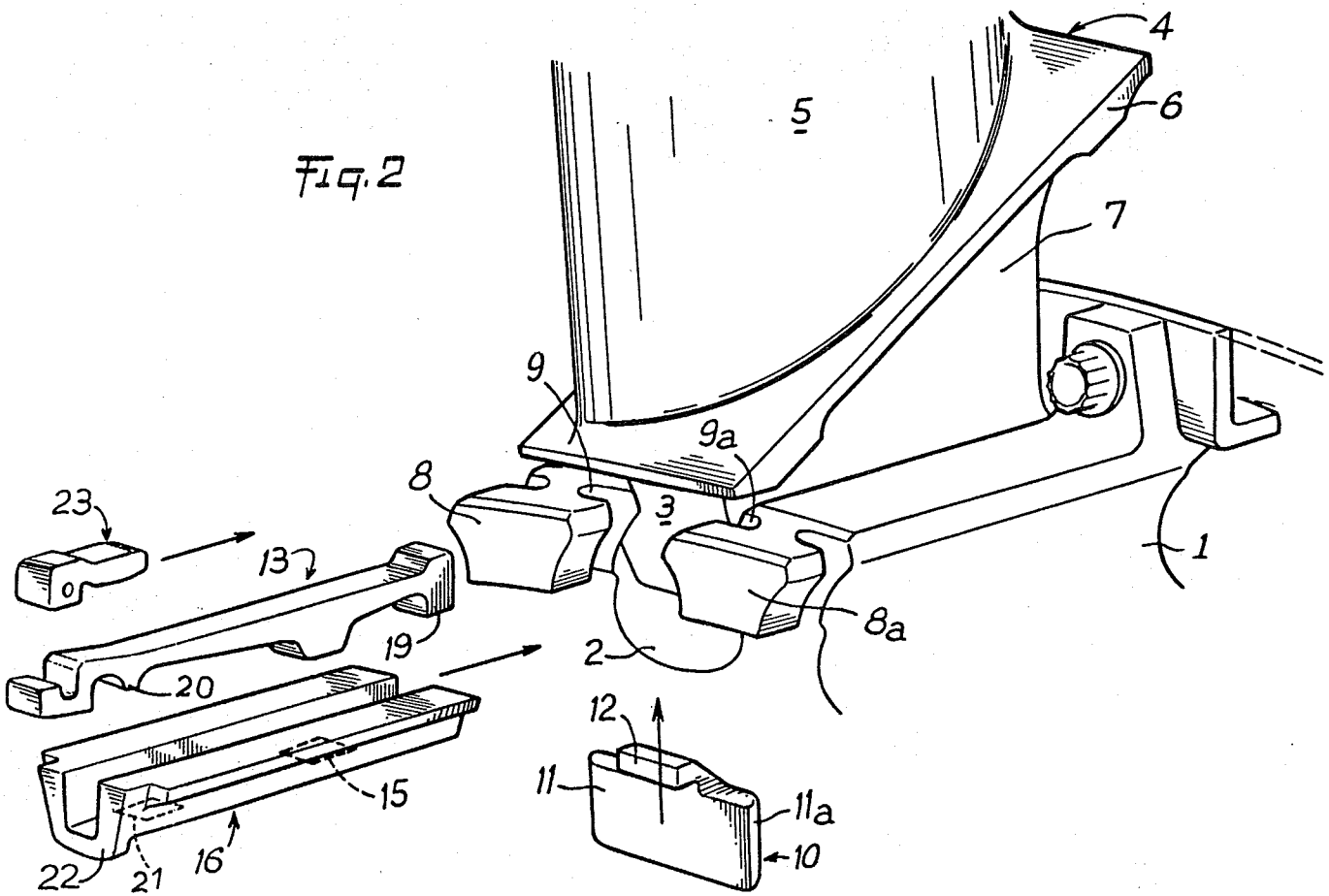
FIG. 2 is an exploded perspective view of the retention device embodying the invention.

A rotor disc 1 of a fan is shown in the drawings having a rim 1 in which are formed axially-orientated grooves 2 of substantially dovetail section.

In each of the grooves 2 a root 3 of a blade 4 is engaged by sliding which comprises an aerofoil section 5, a platform 6 and a stem 7 connecting the aerofoil section to the root 3. The root 3 has a section in the form of a dovetail corresponding to that of the groove 2. More broadly the section of the groove and root are of re-entrant form, or in other words the root can only be inserted and withdrawn axially of the groove.

The rim of the disc 8, 8*a* comprises at its periphery teeth 9, 9*a* extending axially forwardly and provided with radial notches or other recesses 9, 9*a* disposed opposite to one another and in which notches is located an axial locking member 10 for the root 3 of the blade.

The locking member 10 is constituted by a rectangular parallelepiped of which the lateral edges 11, 11*a* are radiussed and engaged in the radial recesses 9, 9*a* and which have on the outer edge a tab 12 abutting the upstream edge of the platform 6 of the blade.

Between the root 3 of the blade and the base of the groove 2, a resilient wedge 13 is engaged of which an abutment 14 located at its central part is engaged in an opening 15 of a channel-section member 16 of elastomer material in the form of a trough member extending axially and interposed between thhe wedge 13, the flanks and the base of the groove 2. The central abutment 14 which is applied against the base of the groove 2 constitutes a central seating of the wedge 13 on the base of the groove and ensures by its engagement in the opening 15 the axial securing of the wedge.

The wedge 13 comprises, in addition, a safety abutment 20, also engaged in an opening 21 of the trough.

The resilient wedge 13 has at the forward end a hook 17 defining a recess 18 to facilitate its extraction by means of a tool; at the rear, the wedge has an abutment 19 which is applied against the root 3 of the blade.

The trough member 16 engaged in the bore 2 has at the front a flip 22 applied against the downstream face of the disc 1.

Between the lower face of the root 3 of the blade and the elastomer wedge 13 a key 23 is interposed which ensures a prestress in the wedge 13, the key being held in place by a front housing 24 secured by means of bolts 25 on to the disc 1.

In order to mount a blade and the retaining device in accordance with the invention, the root 3 of the blade is slid into the groove 2 until its upstream face becomes flush with the upstream face of the disc 1.

The blade 4 is axially locked by means of the locking member 10 which is introduced from inside towards the outside in the recesses 9, 9*a* of the teeth of the disc. The locking member 10 brings the tab 12 into abutment against the internal face of the platform 6, and it is secured in this position by means of a clamp (not shown).

The wedge 13 is then inserted into the trough member 16, the abutment 14 becoming engaged in the opening 15 of the trough member.

The assembly thus formed by the wedge 13 and the trough member 16 is engaged in the groove 2 of the disc, beneath the root 3 of the blade, until the lip 22 abuts against the upstream face of the disc 1. It is then possible to withdraw the clamp holding the locking member 10.

With the aid of a tool applied against the teeth 8, 8*a* of the disc and on the hook 17 of the wedge 13, the resilient wedge 13 is bent towards the axis of the machine. After the introduction of the key 23 between the wedge and the root of the blade, the wedge is slackened so that by reaction, the resilient wedge 13 forces the root 3 of the blade against the flanks of the disc.

The key 23 is then locked in place by means of the forward housing 24 secured on the disc 1.

I claim:

1. In a retention device for use in securing a fan blade axially and radially, the blade having a platform and a root of re-entrant form and thus being capable only of axial sliding into a corresponding groove in the rim of a fan rotor disc, means defining axially-extending teeth adjacent the periphery of the rim of the disc and adjacent pairs of said teeth having opposed radial recesses locking means of each blade being engaged in said two adjacent opposed recesses and serving to lock the blade axially, a resilient wedge interposed between the root of the blade and the bottom of the groove in order to exert on the blade root a force directed radially outwardly, and a holding key pre-stressing the wedge and interposed between the wedge and the internal downstream face of the root of the blade, the improvement comprising, a trough-shaped member interposed between the resilient wedge and the flanks and bottom of said groove, the trough-shaped member extending axially of the fan, and having an opening intermediate its ends, and means defining an abutment on the wedge which engages in the opening of the trough-shaped member and seats on the bottom of the groove.

2. A device according to claim 1, wherein the trough-shaped member further comprises a lip at the forward end which lips abuts the upstream face of the fan disc.

3. A device according to claim 1, wherein the trough-shaped member has a further opening, and the wedge has a further, forward abutment passing through said further opening and seating on the bottom of the groove.

4. A device according to claim 1, wherein the locking means comprises a rectangular parallelepiped of which the lateral edges engage in the said radial recesses of the teeth, the locking means having at its outer edge a tab abutting the associated blade beneath the upstream edge of the platform and the key being engaged between the radially inner edge of the locking means and the wedge.

5. A device according to claim 1, wherein the wedge of elastomer material has a forward hook-like part with an aperture capable of receiving a tool to facilitate the withdrawal thereof by means of the tool.

6. A device according to claim 1, wherein the wedge has a rearwards abutment seating on the bottom of the said groove.

7. In a fan rotor assembly, a fan disc having a rim with axial grooves, a plurality of fan blades each having an aerofoil portion, an intermediate platform and a root of re-entrant form which can slide axially into a corresponding said groove, means on said rim defining axially-extending teeth and adjacent pairs of said teeth having opposed radial recesses, locking means of each blade engaged in the opposed pairs of recesses and serving to lock the blades axially, wedges of resilient material interposed each between the root of a said blade and the bottom of the corresponding axial groove each wedge having an abutment seating on the bottom of the corresponding groove, a holding key pre-stressing the wedge and interposed between the internal downstream face of the root of the blade and the wedge, and trough-shaped members each interposed between the wedge and the flanks and bottom of the corresponding groove, the members extending axially of the fan and each having an opening through which the abutment of the corresponding wedge seats on the bottom of the corresponding groove.

* * * * *